US009010224B2

(12) United States Patent
Imamaki et al.

(10) Patent No.: US 9,010,224 B2
(45) Date of Patent: Apr. 21, 2015

(54) ROTARY CUTTER DEVICE

(71) Applicant: Brother Kogyo Kabushiki Kaisha, Nagoya-shi, Aichi-ken (JP)

(72) Inventors: Teruo Imamaki, Nisshin (JP); Akira Sago, Seto (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 167 days.

(21) Appl. No.: 13/749,951

(22) Filed: Jan. 25, 2013

(65) Prior Publication Data

US 2013/0192438 A1 Aug. 1, 2013

(30) Foreign Application Priority Data

Jan. 31, 2012 (JP) ..... 2012-018467

(51) Int. Cl.
*B26D 7/00* (2006.01)
*B26D 1/38* (2006.01)
*B65H 35/00* (2006.01)

(52) U.S. Cl.
CPC ..... *B26D 1/385* (2013.01); *B65H 35/0086* (2013.01); *B26D 2007/005* (2013.01)

(58) Field of Classification Search
CPC ..... B26D 1/385; B26D 2007/005; B65H 35/0086
USPC ..... 83/349, 341
See application file for complete search history.

(56) References Cited

U.S. PATENT DOCUMENTS 1,005,879 A * 10/1911 Ries ..... 83/167
2,130,473 A * 9/1938 Ruau ..... 83/583
3,868,878 A * 3/1975 Peak ..... 83/356.3
4,114,491 A * 9/1978 Hashimoto et al. ..... 83/341
4,230,281 A * 10/1980 Hill et al. ..... 241/142
4,233,800 A * 11/1980 Long et al. ..... 53/381.6
4,244,251 A * 1/1981 Iwao et al. ..... 83/349
4,363,453 A * 12/1982 Hill et al. ..... 241/222
4,422,358 A * 12/1983 Hull et al. ..... 83/356.3
4,667,554 A * 5/1987 Peery ..... 83/583
5,000,069 A * 3/1991 Knobel ..... 83/285
5,359,915 A * 11/1994 Hitz ..... 83/342
6,209,432 B1 * 4/2001 Matsuda ..... 83/342
6,647,849 B2 * 11/2003 Jones ..... 83/698.42
6,772,663 B2 * 8/2004 Machamer ..... 83/37
7,191,690 B2 * 3/2007 Pollock et al. ..... 83/37
7,213,781 B2 * 5/2007 Pakura ..... 241/294
2013/0118328 A1 * 5/2013 Salamone ..... 83/346
2013/0118330 A1 * 5/2013 Sago et al. ..... 83/596
2013/0192438 A1 * 8/2013 Imamaki et al. ..... 83/349
2014/0000430 A1 * 1/2014 Nagura et al. ..... 83/116

FOREIGN PATENT DOCUMENTS

JP S60001997 1/1985
JP 2008-161768 7/2008

* cited by examiner

*Primary Examiner* — Sean Michalski
(74) *Attorney, Agent, or Firm* — McCarter & English, LLP

(57) ABSTRACT

A rotary cutter device includes a rotating body, a plurality of rotary blades, a fixed blade, a feeding portion, and a control portion. The rotating body is configured to be rotatable around a central axis. The plurality of rotary blades are provided on the rotating body. The fixed blade is provided facing a trajectory that cutting edges of the plurality of rotary blades describe when the plurality of rotary blades rotate. The feeding portion is configured to feed a sheet-shaped object along a linear feed path that passes close to the fixed blade. The control portion is configured to rotate the plurality of rotary blades around the central axis toward the fixed blade from the opposite side of the feed path from the fixed blade.

6 Claims, 12 Drawing Sheets

ROTARY CUTTER DEVICE

CROSS-REFERENCE TO RELATED APPLICATION

This application claims priority to Japanese Patent Application No. 2012-18467, filed Jan. 31, 2012, the disclosure of which is incorporated herein by reference in its entirety.

BACKGROUND

The present disclosure relates to a rotary cutter device that cuts a sheet-shaped object that is conveyed to the rotary cutter device.

A rotary cutter device is known that cuts a sheet-shaped object that is conveyed to the rotary cutter device. The rotary cutter device is provided with a helical blade on the outer circumference of a circular cylindrical body portion. The object is cut in a straight line by the helical blade while the object is being conveyed.

SUMMARY

Only the one blade is provided on the body portion of the rotary cutter device. With this configuration, it is necessary for the body portion to make at least one complete revolution in order for the object to be cut by the blade. Therefore, in a case where the object is cut a plurality of times in sequence, the possibility arises that the efficiency of the cutting work will become reduced.

Accordingly, if a plurality of the helical blades were to be provided on the outer circumference of the circular cylindrical body portion, the object that is being conveyed would be cut a plurality of times in sequence with each complete revolution of the body portion. With that configuration, as the body portion rotates, at the same time that one of the blades rotates to a position where it cuts the object (a cutting position), the remaining blades rotate to positions where they do not cut the object (non-cutting positions). In such a case the blades that have rotated to the non-cutting positions may interfere with the object that has been cut by the blade that is in the cutting position, thereby impeding the conveying of the object.

Various exemplary embodiments of the general principles herein provide a rotary cutter device that is able to cut a sheet-shaped object efficiently while inhibiting the impeding of the conveying of the sheet-shaped object.

The exemplary embodiments described herein provide a rotary cutter device that includes a rotating body, a plurality of rotary blades, a fixed blade, a feeding portion, and a control portion. The rotating body is configured to be rotatable around a central axis. The plurality of rotary blades are provided on the rotating body in parallel to the central axis. Each of the plurality of rotary blades is separated from the central axis and has a cutting edge on an end of the rotary blade that is farthest from the central axis. The cutting edges of the plurality of rotary blades extend in parallel to the central axis and describe a trajectory when the plurality of rotary blades rotate. The fixed blade is provided on an outer side of the trajectory and has a cutting edge on an end of the fixed blade. The cutting edge of the fixed blade faces the trajectory. The feeding portion is configured to feed a sheet-shaped object along a linear feed path that passes close to the fixed blade. The feed path passes from a cutting position through an area that is on the inner side of the trajectory. The cutting position is a position where one of the cutting edges of the plurality of rotary blades faces the cutting edge of the fixed blade. The feed path then extends from a discharge position into an area that is on the outer side of the trajectory. The discharge position is a position where the feed path and the trajectory intersect and is different from the cutting position. The control portion is configured to rotate the plurality of rotary blades around the central axis toward the fixed blade from the opposite side of the feed path from the fixed blade.

BRIEF DESCRIPTION OF THE DRAWINGS

Exemplary embodiments of the present disclosure will be described below in detail with reference to the accompanying drawings in which.

DETAILED DESCRIPTION

An embodiment of the present disclosure will be explained with reference to the drawings. The present embodiment is an example of a case in which the rotary cutter device of the present disclosure is used in a label-making device. In the explanation that follows, the upper side, the lower side, the lower left side, the upper right side, the upper left side, and the lower right side in FIG. 1 are respectively defined as the upper side, the lower side, the front side, the rear side, the left side, and the right side of a label-making device 500.

Figure 1:
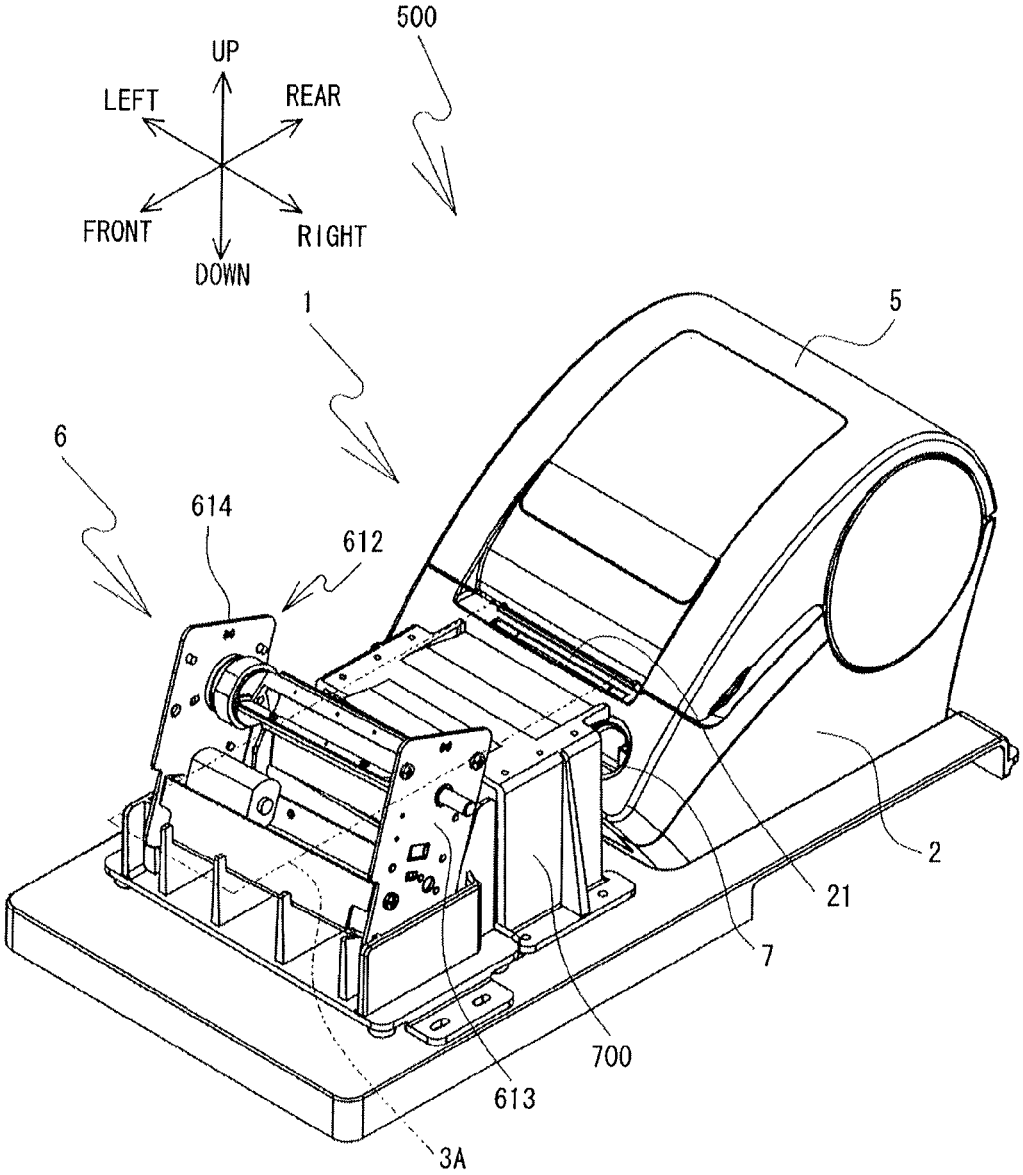
FIG. 1 is an oblique view of a label-making device.

As shown in FIG. 1, the label-making device 500 is provided with a main unit 1 and a rotary cutter device 6. The main unit 1 is capable of printing characters (text characters, numerals, symbols, graphics, and the like) on a long tape 3A (refer to FIG. 3). The rotary cutter device 6 is capable of cutting the tape 3A on which the main unit 1 has performed the printing.

Figure 2:
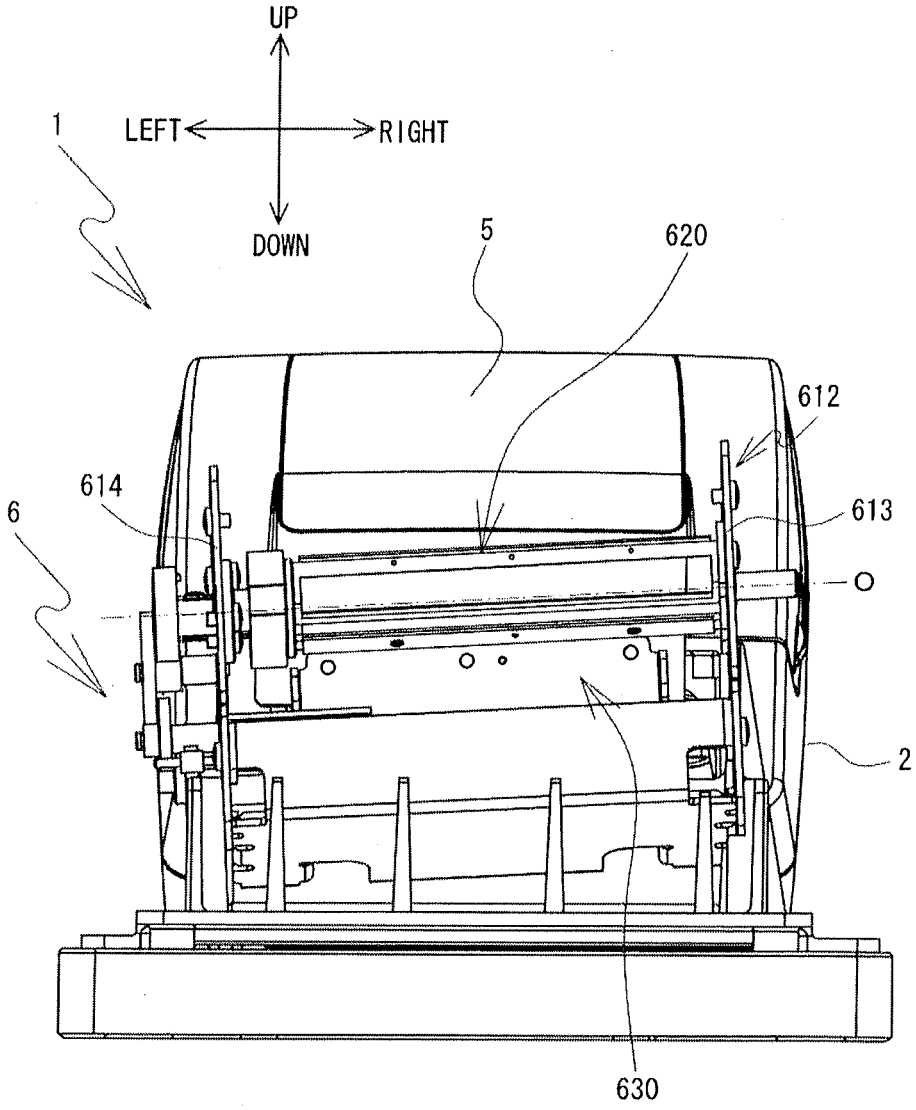
FIG. 2 is a front view of the label-making device.

The configuration of the main unit 1 will be explained with reference to FIGS. 1 to 3. As shown in FIGS. 1 and 2, the main unit 1 has a rectangular parallelepiped shape that is long in the front-rear direction, with its upper surface rounded into an arc shape. The main unit 1 is provided with a housing 2 that covers the bottom portion of the main unit 1 and with a cover 5 that covers the top of the housing 2. A power switch 7 and various types of input keys (not shown in the drawings) are provided on the upper surface of the front end portion of the housing 2. The cover 5 opens and closes freely, supported by the rear edge of the main unit 1, which extends in the left-right direction. An outlet slot 21 that is long in the left-right direction is provided between the power switch 7 and the cover 5. After the printing, the tape 3A (refer to FIG. 3) is discharged from the outlet slot 21.

Figure 3:
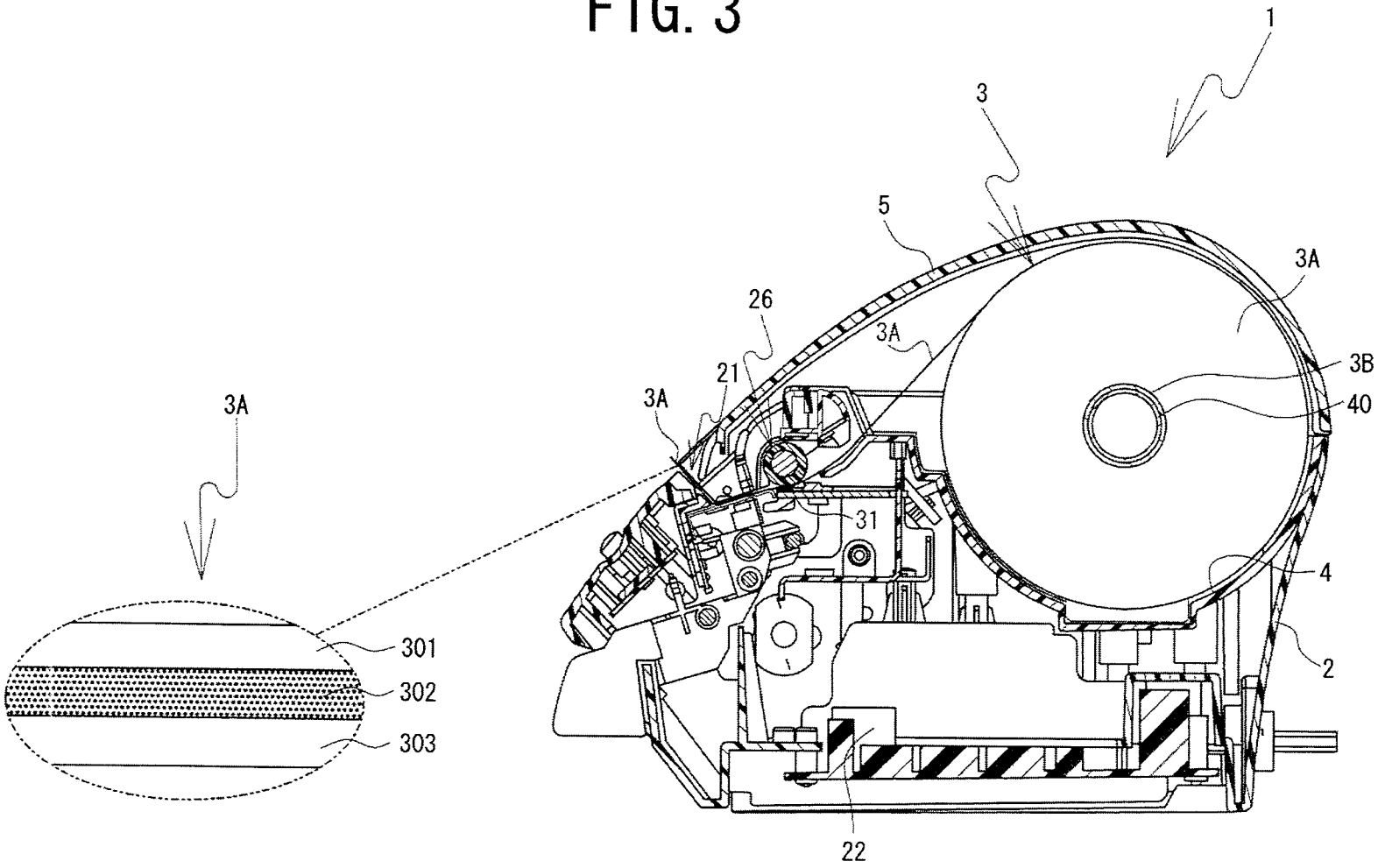
FIG. 3 is a section view of a body of the label-making device, as seen from the right side.

As shown in FIG. 3, a holder containing portion 4 that is capable of containing a tape holder 3 is provided in a space inside the housing 2. In a side view, the holder containing portion 4 is recessed downward in a circular arc shape. In the tape holder 3, the tape 3A is wound into a roll shape around a core 3B that has a substantially cylindrical shape. A holder shaft member 40 that has a substantially cylindrical shape is provided on the inner circumference side of the core 3B. The holder shaft member 40 supports the core 3B, around which the tape 3A is wound, such that the core 3B rotates around a central axis that is parallel to the left-right direction.

In the present embodiment, the tape 3A is a tape for making labels and has a three-layer structure (refer to the enlarged portion in FIG. 3). More specifically, the layers of the tape 3A are a release paper 301, an adhesive layer 302, and a heat-sensitive paper 303, in that order. To put another way, the release paper 301 is affixed to the back side of the heat-sensitive paper 303 through the adhesive layer 302. In the end, peeling off the release paper 301 makes it possible for the finished label (not shown in the drawings) to be affixed to an object or the like by the adhesive layer 302.

A thermal head 31 that performs the printing on the tape 3A is provided in a fixed position in front of the holder containing portion 4 (that is, on the downstream side of the holder containing portion 4 in the direction in which the tape 3A that is wound around the core 3B is fed). A platen roller 26 that can be rotated by a stepping motor that is not shown in the drawings is provided above the thermal head 31. The platen roller 26 pulls out the tape 3A that is wound around the core 3B and feeds the tape 3A along a feed path that extends forward toward the outlet slot 21. The thermal head 31 and the platen roller 26 are disposed opposite one another, with the feed path for the tape 3A passing between them. Note that the broken line in FIG. 1 (and in FIG. 4) indicates the feed path for the fed tape 3A.

A lever (not shown in the drawings) for moving the platen roller 26 up and down is provided to the left and in front of the holder containing portion 4. When the cover 5 is opened, the lever is rotated upward by the energizing force of a coil spring (not shown in the drawings), causing the platen roller 26 to move upward. This separates the platen roller 26 from the thermal head 31 and the tape 3A, so the main unit 1 is put into a state in which printing is disabled. When the cover 5 is open, the tape holder 3 can be removed from and put back into the holder containing portion 4. In contrast, when the cover 5 is closed, the lever is pressed downward by the cover 5, and the platen roller 26 moves downward. The platen roller 26 thus presses the tape 3A against the thermal head 31, so the main unit 1 is put into a state in which printing is enabled (refer to FIG. 3).

A control board 22 that operates and controls the main unit 1 is provided in the space inside the housing 2. The control board 22 is provided with a CPU, a ROM, a RAM, and the like that are not shown in the drawings. The CPU executes programs that are stored in advance in the ROM, while utilizing a temporarily storage function of the RAM. When the main unit 1 is in a state in which printing is enabled and a command is issued to start printing, the control board 22 feeds the tape 3A by rotationally driving the platen roller 26. In synchronization with the feeding of the tape 3A, the control board 22, by controlling the operation of the thermal head 31, causes the printing to be performed on the tape 3A that is being fed. After the printing is completed, the tape 3A is discharged from the outlet slot 21 and is then cut by the rotary cutter device 6, which will be described later, thus creating a label that is not shown in the drawings. The rotary cutter device 6 is also operated and controlled by the control board 22.

As shown in FIG. 1, a guiding carrier stand 700 is provided in front of the main unit 1 (on the downstream side of the outlet slot 21 in the feed direction). The rotary cutter device 6 is disposed in front of the guiding carrier stand 700 (that is, on the downstream side in the feed direction). The guiding carrier stand 700 guides the printed tape 3A that has been discharged from the outlet slot 21 toward a rotating body 620 of the rotary cutter device 6, which will be explained below.

The configuration and operation of the rotary cutter device 6 will be explained with reference to FIGS. 4 to 9. The rotary cutter device 6 is provided with a housing 612, the rotating body 620, a holding body 630, and the like. The rotating body 620 is a member that includes a plurality of rotary blades 621 that is configured to be rotatable about a central axis O. The holding body 630 is a member that is configured to hold a fixed blade 631. The fixed blade 631 is capable of cutting the tape 3A by operating in conjunction with the rotary blades 621. The housing 612 is a structural unit in which the rotating body 620, the holding body 630, and the like are provided.

Figure 4:
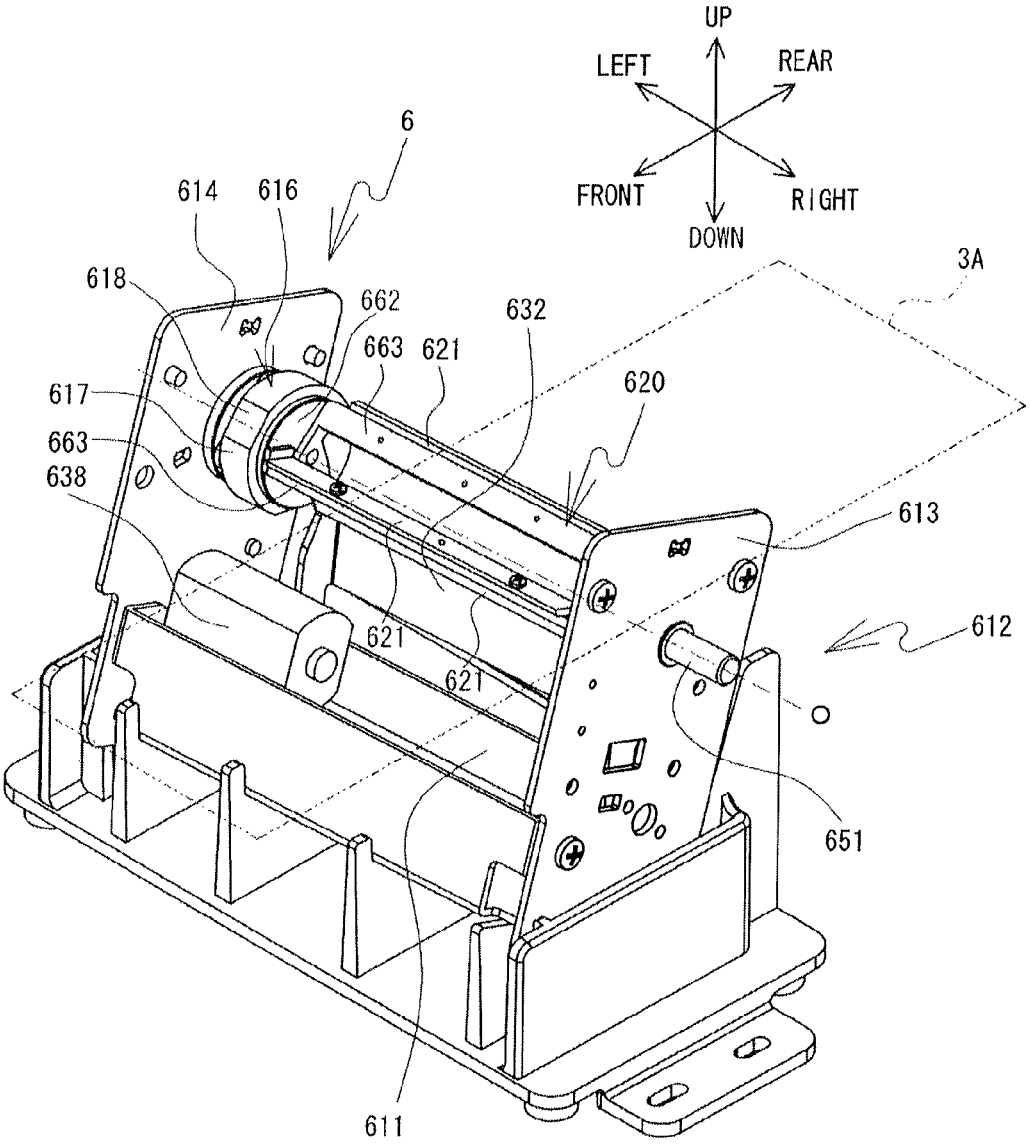
FIG. 4 is an oblique view of a rotary cutter device.
Figure 5:
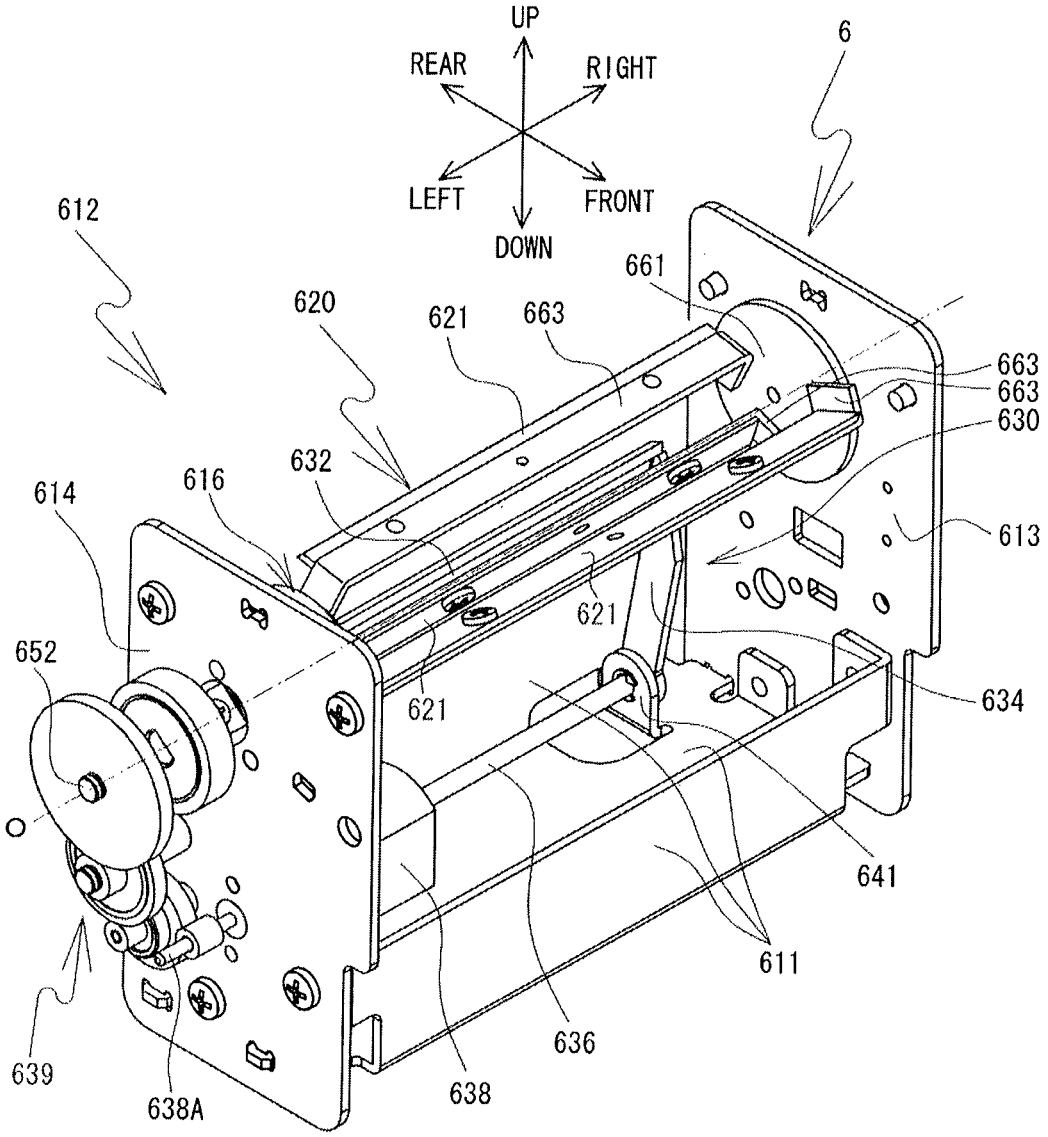
FIG. 5 is an oblique view of the rotary cutter device, as seen from a different direction.
Figure 6:
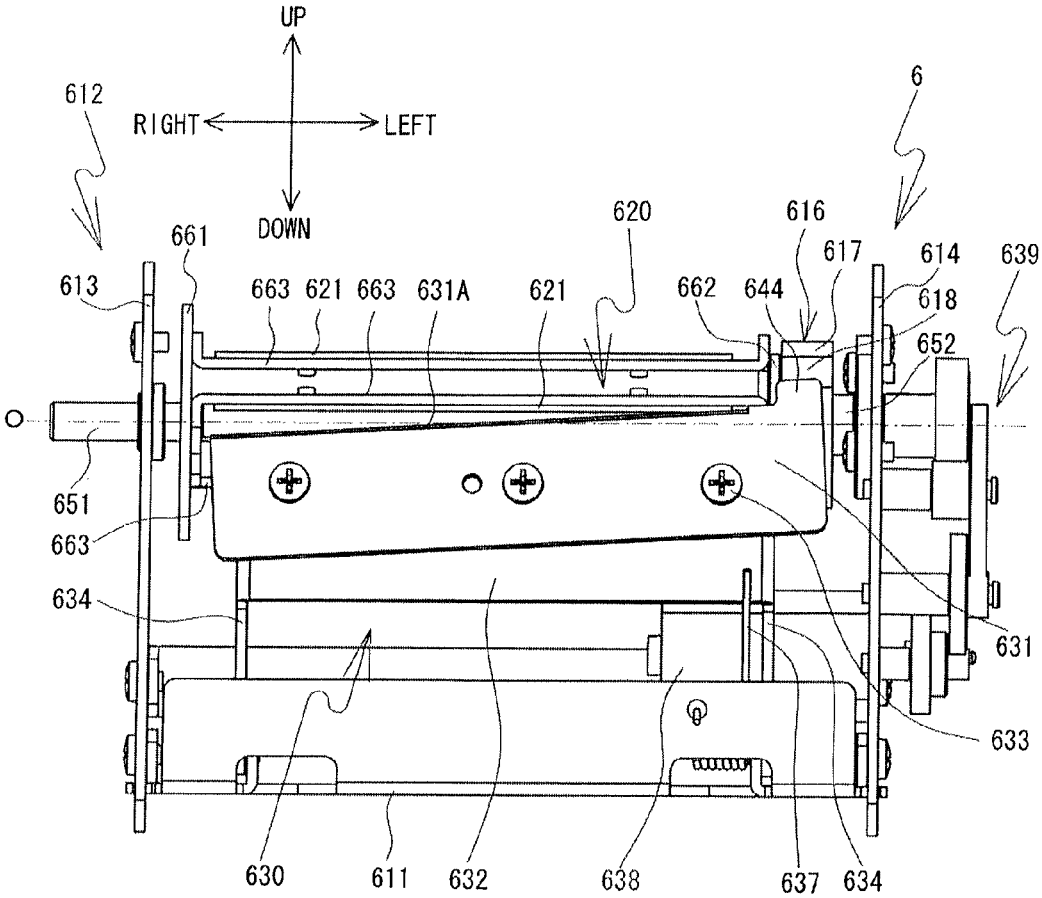
FIG. 6 is a rear view of the rotary cutter device.

The configuration of the housing 612 will be explained. As shown in FIGS. 4 to 6, the housing 612 is provided with a first wall portion 613, a second wall portion 614, and a connecting portion 611. The first wall portion 613 is a wall portion that is provided at the right end of the housing 612, and extends obliquely upward toward the rear in the right side portion of the rotary cutter device 6. The second wall portion 614 is a wall portion that is provided at the left end of the housing 612, and extends obliquely upward toward the rear in the left side portion of the rotary cutter device 6. The connecting portion 611 connects the lower portion of the first wall portion 613 and the lower portion of the second wall portion 614. The connecting portion 611 is a wall portion that is provided in the lower portion of the housing 612, and front and rear edges of the connecting portion 611 are bent upward and extend upward to a certain degree.

Note that the housing 612 is disposed in the rotary cutter device 6 in an orientation in which the first wall portion 613 and the second wall portion 614 are tilted somewhat to the left from the vertical (refer to FIG. 2). In the rotary cutter device 6 that is shown in FIGS. 4 to 12, the housing 612 is disposed such that the orientations of the first wall portion 613 and the second wall portion 614 are aligned to the vertical to facilitate the explanation and make the drawings easier to understand.

The configuration of the rotating body 620 will be explained. As shown in FIGS. 4 to 6, the rotating body 620 is disposed between the first wall portion 613 and the second wall portion 614. The rotating body 620 is provided with a first disk 661, a second disk 662, three brackets 663, and the like. The first disk 661 is a circular plate-shaped member that is disposed on the left side face of the first wall portion 613. The second disk 662 is the same sort of circular plate-shaped member as the first disk 661. The second disk 662 is disposed on the right side face of the second wall portion 614.

The first disk 661 and the second disk 662 are disposed to be opposite one another in the left-right direction and are separated by a distance that is greater than the width of the tape 3A. In a state in which the orientations of the first wall portion 613 and the second wall portion 614 are aligned to the vertical (refer to FIGS. 4 to 12), the positions of the centers of the first disk 661 and the second disk 662 are aligned with one another in a side view. A rotating shaft 651 that extends toward the right from the first disk 661 passes through and is rotationally supported by the first wall portion 613. A rotating shaft 652 that extends toward the left from the second disk 662 passes through and is rotationally supported by the second wall portion 614. Therefore, in the state in which the orientations of the first wall portion 613 and the second wall portion 614 are aligned to the vertical (refer to FIGS. 4 to 12), a line connecting the centers of rotation of the first disk 661 and the second disk 662 (that is, the central axis O of the rotating body 620) are parallel to the left-right direction.

The three brackets 663 are plate-shaped members that extend in the left-right direction and span the distance between the first disk 661 and the second disk 662. The right end of each of the brackets 663 is affixed to the left face of the first disk 661. The left end of each of the brackets 663 is affixed to the right face of the second disk 662. More specifically, in a side view, the three brackets 663 are disposed at uniform intervals of 120 degrees around the central axis O. Moreover, in a side view, the individual brackets 663 are disposed at approximately equal distances from the central axis O. Therefore, a gap is formed between the central axis O and each of the brackets 663. The gap is longer in the left-right direction than the width of the tape 3A In a side view, each of the brackets 663 extends outward in the radial direction from the central axis O. One of the rotary blades 621, which have identical flat blade shapes, is provided on one side face of the each of the brackets 663. In other words, the rotating body 620 has three rotary blades 621, each of which extends in the direction away from the central axis O in a side view. Each of the rotary blades 621 has a cutting edge 621A (refer to FIG. 7) on an end of the rotary blade 621 that is farthest from the central axis O, and each of the cutting edges 621A has a width in the left-right direction that is parallel to the central axis O. For each of the rotary blades 621, the width in the direction in which the cutting edge 621A extends (i.e. the width in the left-right direction) is greater than the width of the tape 3A.

A stepping motor 638 that supplies the driving force that rotates the rotating body 620 is provided in the lower portion of the housing 612 on the second wall portion 614 side. A drive shaft 638A of the stepping motor 638 passes through the second wall portion 614. A drive transmission mechanism 639 that is a gear train is provided on the left face of the second wall portion 614. The drive transmission mechanism 639 is capable of operationally linking the drive shaft 638A of the stepping motor 638 and the rotating shaft 652 that extends to the left from the second disk 662.

When the drive shaft 638A of the stepping motor 638 rotates, the rotating shaft 652 is rotated through the drive transmission mechanism 639. Thus, in the rotating body 620, the first disk 661 and the second disk 662, which are supported by the rotating shafts 651, 652, rotate, so the three brackets 663 (that is, the three rotary blades 621) also rotate around the central axis O. In the present embodiment, the rotating body 620 is rotated in a counterclockwise direction in a left side view by the rotation of the stepping motor 638 (refer to FIG. 8). Note that because the distances from the central axis O to the cutting edges 621A of the individual rotary blades 621 are all equal, the cutting edge 621A of each of the rotating rotary blades 621 describes an identical trajectory R that is centered on the central axis O (refer to FIG. 8).

As shown in FIGS. 4 to 7, a cam 616 is attached to the rotating shaft 652 between the second wall portion 614 and the second disk 662. The cam 616 has an approximately circular cylindrical shape, the central axis of which is the central axis O, and pressing portions 617 and notched portions 618 are formed on the outer circumferential face of the cam 616. The notched portions 618 are areas that are notched such that the outline of the circular shape is recessed toward the inside in a side view. The notched portions 618 are formed in three locations on the outer circumferential face of the cam 616 at 120-degree intervals around the central axis O. More specifically, the three notched portions 618 correspond to the three rotary blades 621, and in a side view, each of the notched portions 618 is formed on the downstream side of the corresponding rotary blade 621 in the direction of rotation (in the present embodiment, in positions that proceed in the counterclockwise direction in a left side view). The locations other than the three notched portions 618 on the outer circumferential face of the cam 616 are the circular arc-shaped pressing portions 617. Each of the notched portions 618 and each of the pressing portions 617 comes into contact with a receiving portion 644 that will be described later.

Figure 7:
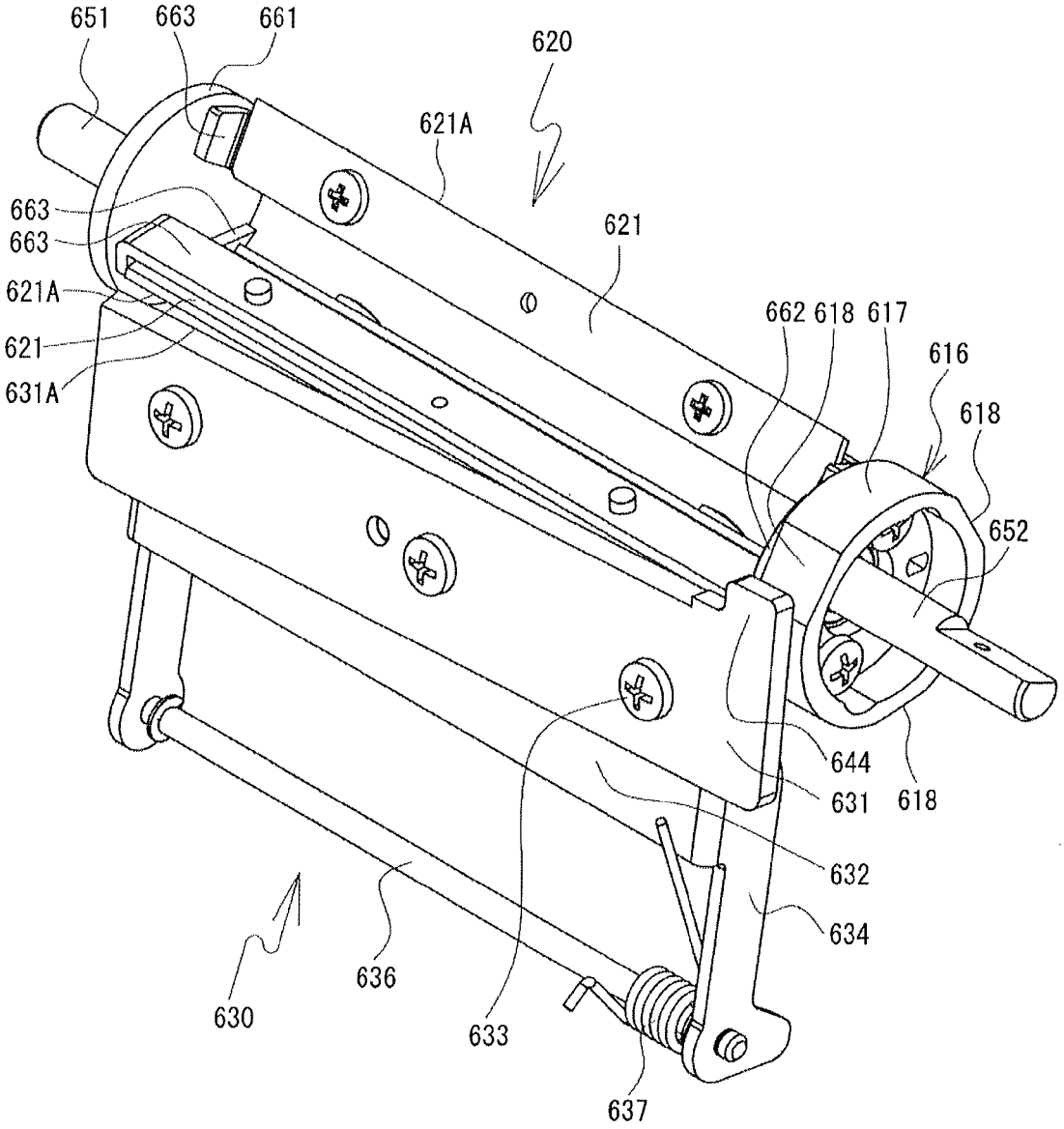
FIG. 7 is an enlarged oblique view of a rotating body and a holding body.

The configuration of the holding body 630 will be explained. As shown in FIGS. 5 to 7, the holding body 630 has a plate-shaped holding portion 632 on which the fixed blade 631 is provided. The holding portion 632 has a left-right pair of extending portions 634 that extend downward from the left and right ends of the holding portion 632. A support shaft 636 connects the lower ends of the left-right pair of the extending portions 634. A left-right pair of hinge arms 641 are provided underneath the rotating body 620. The left-right pair of the hinge arms 641 are standing on the connecting portion 611 and have holes that pass through the hinge arms 641 in the left-right direction. The support shaft 636 is inserted into the holes in the left-right pair of the hinge arms 641 such that the support shaft 636 rotates freely. That is, the holding portion 632 is rotatably supported by the left-right pair of the extending portions 634 in relation to the housing 612.

The fixed blade 631 is affixed by screws 633 to a rear flat portion of the holding portion 632. The fixed blade 631 is provided on an outer side of the trajectory R (refer to FIG. 8). The width of the fixed blade 631 in the left-right direction is greater than the width of the tape 3A. The fixed blade 631 has a cutting edge 631A on an end of the fixed blade 631. The cutting edge 631A that is formed on the upper edge of the fixed blade 631 projects upward higher than the upper edge of the holding portion 632. Furthermore, the direction in which the cutting edge 631A extends is inclined in relation to the central axis O, irrespective of the rotational positions of the extending portions 634 (refer to FIGS. 2, 6). Therefore, the cutting edge 631A of the fixed blade 631 is inclined in the same manner in relation to each of the rotary blades 621.

A coil spring 637 is wound around the left end of the support shaft 636. One end (the rear end) of the coil spring 637 is affixed to a wall portion of the rear edge of the connecting portion 611, and the other end (the upper end) of the coil spring 637 is in contact with the rear portion of the holding portion 632. The upwardly extending receiving portion 644 is provided on the upper left edge of the fixed blade 631. The coil spring 637 energizes the holding portion 632 toward the front (in other words, in the direction that brings the holding portion 632 closer to the rotating body 620), so the receiving portion 644 is pressed against the cam 616. When the receiving portion 644 is in contact with one of the pressing portions 617 of the cam 616, the cutting edge 631A is held in a retracted position that is separated from the trajectory R (refer to FIG. 9). When the receiving portion 644 is in contact with one of the notched portions 618 of the cam 616, the cutting edge 631A is held in a ready position that faces (that is, is close to) the trajectory R (refer to FIG. 8).

Figure 8:
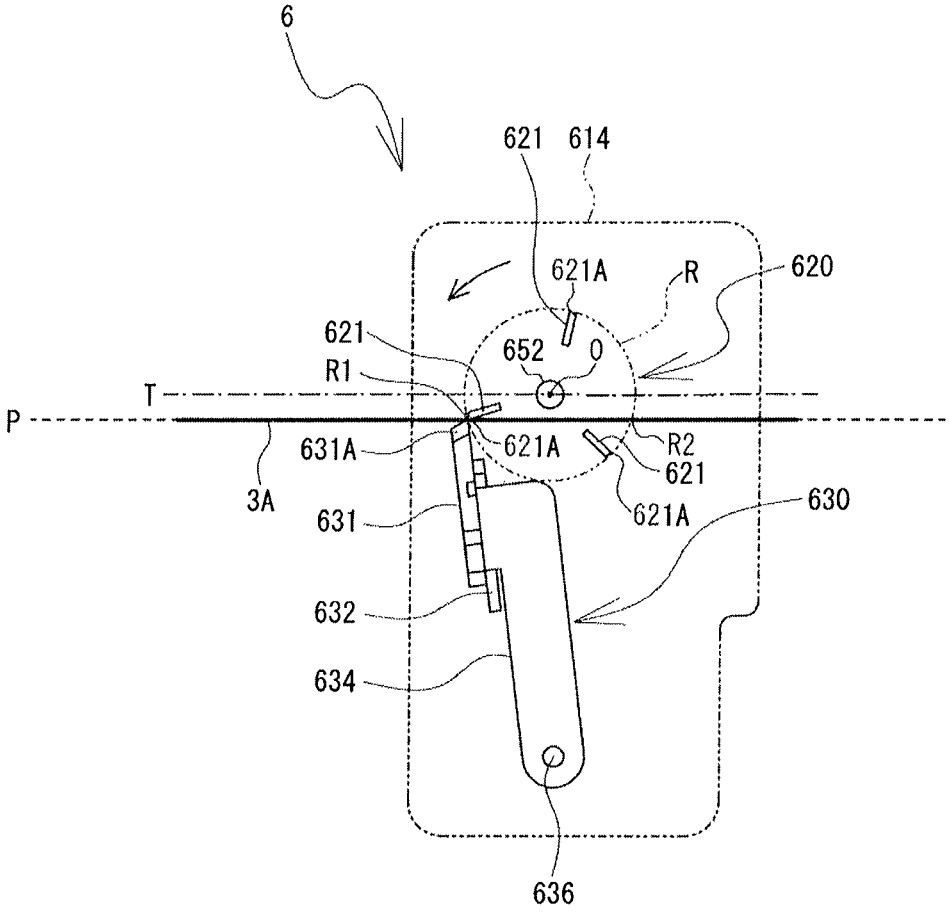
FIG. 8 is a side view that schematically shows an operating mechanism of the rotary cutter device.

A feed path P for the tape 3A in the rotary cutter device 6 will be explained with reference to FIG. 8. In order to facilitate the explanation and make the drawing easier to understand, in FIG. 8 the rotating body 620 is indicated only by the three rotary blades 621 and the rotating shaft 652, and the receiving portion 644 has been omitted from the holding body 630.

As explained previously, in the label-making device 500, the printed tape 3A that has been discharged from the main unit 1 is fed to the rotary cutter device 6 by way of the guiding carrier stand 700 (refer to FIGS. 1, 2). In the rotary cutter device 6, the printed tape 3A is fed along the feed path P that passes close to the fixed blade 631, which is a straight line in a side view (refer to FIG. 8). The feed path P is parallel to a horizontal plane T that passes through the center of rotation of the second disk 662 horizontally. The feed path P extends forward slightly below the horizontal plane T. The central axis O is located on the opposite side of the feed path P from the fixed blade 631 (that is, the central axis O is offset such that the central axis O is separated from the feed path P).

In a side view, the feed path P passes through the area that is on the inner side of the trajectory R that is described by each of the rotating rotary blades 621. In a side view, the feed path P intersects the trajectory R at two points (a cutting position R1 and a discharge position R2). The cutting position R1 is located at the point on the feed path P that is the farthest upstream within the area that is on the inner side of the trajectory R. The cutting position R1 is a position where one of the cutting edges 621A of the plurality of rotary blades 621 faces the cutting edge 631A of the fixed blade 631. The discharge position R2 is located at the point on the feed path P that is the farthest downstream within the area that is on the inner side of the trajectory R. The discharge position R2 is a position where the feed path P and the trajectory R intersect that is different from the cutting position R1. The discharge position R2 is on the opposite side of a vertical plane S from the cutting position R1, the vertical plane S passing through the central axis O of the rotating body 620 (refer to FIG. 9).

As explained previously, the direction of rotation of the rotating body 620 is counterclockwise in a left side view, and the central axis O is offset from the feed path P. Therefore, the individual rotating rotary blades 621 move in order in relation to the fixed blade 631 (more specifically, the cutting edge 631A) from above the feed path P to below the feed path P. The cutting edge 621A of rotary blade 621 that has rotated to the cutting position R1 is the closest to the fixed blade 631 (more specifically, the cutting edge 631A). At the cutting position R1, the tape 3A, which has been guided by way of the guiding carrier stand 700, advances into the area that is on the inner side of the trajectory R, where it is cut in a straight line by the coordinated operating of the rotary blade 621 and the fixed blade 631. In the present embodiment, an angle r that is formed between the horizontal plane T and the rotary blade 621 at the cutting position R1, with its vertex at the central axis O, is 17 degrees (refer to FIG. 9).

A gap is formed between the central axis O of the rotating body 620 and each of the rotary blades 621, the gap extending along the central axis O. Therefore, when none of the rotary blades 621 is located at either the cutting position R1 or the discharge position R2, the tape 3A on the feed path P is able to pass through the area that is on the inner side of the trajectory R in a straight line. At the discharge position R2, the tape 3A that has passed through the area that is on the inner side of the trajectory R is discharged to the area that is on the outer side of the trajectory R (toward the front from the trajectory R).

Figure 9:
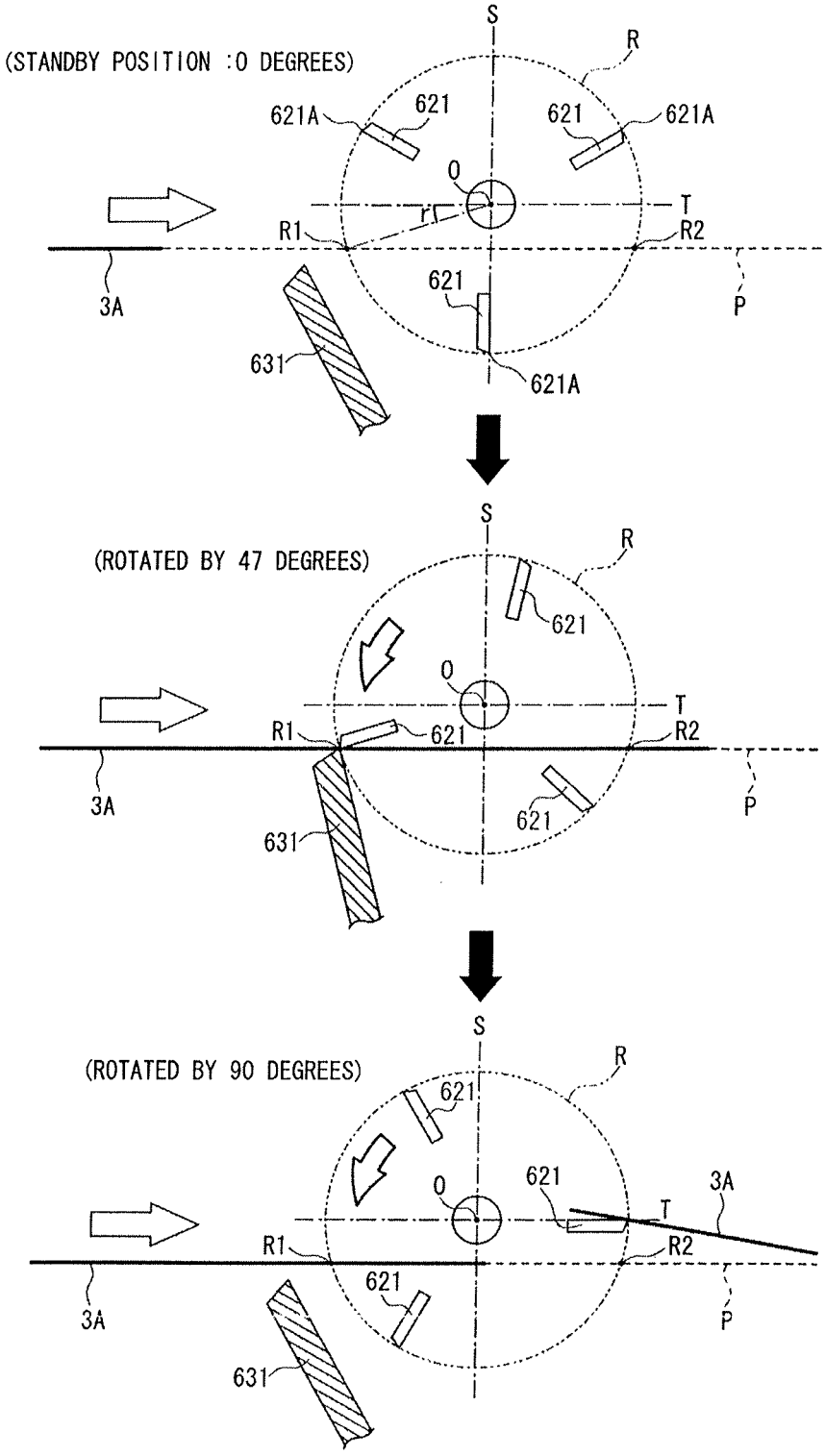
FIG. 9 is an explanatory figure that shows a flow of an operation of cutting a tape.

The operation of the rotary cutter device 6 according to the present embodiment will be explained with reference to FIG. 9. When the main unit 1 is started by the pressing of the power switch 7, the control board 22 causes the rotating body 620 to rotate, moving each of the rotary blades 621 to a standby position. One of the rotary blades 621 thus moves to a position directly below the central axis O that is the lowest position for the rotary blades 621. Two of the rotary blades 621 move to positions that are higher than the central axis O, where the two of the rotary blades 621 are symmetrically inclined at angles of 60 degrees forward and rearward from the vertical plane S. In the explanation that follows, the angle of rotation of the rotating body 620 when each of the rotary blades 621 is in the standby position is defined as zero degrees.

When the printing operation of the main unit 1 is started, the printed tape 3A that is discharged from the main unit 1 toward the rotary cutter device 6 is fed along the feed path P. When each of the rotary blades 621 is in the standby position, all three of the rotary blades 621 are at positions other than the cutting position R1 and the discharge position R2. At the same time, the receiving portion 644 is in contact with one of the pressing portions 617 of the cam 616, so the cutting edge 631A is held in the retracted position that is separated from the trajectory R. Therefore, the rotary blades 621 and the fixed blade 631 do not interfere with the tape 3A, and the tape 3A moves forward along the feed path P toward the rotary cutter device 6.

After the printing operation has started, the control board 22 causes the rotating body 620 (that is, the three rotary blades 621) to rotate in synchronization with the feeding of the tape 3A. When the rotating body 620 rotates by a specified amount, the portion of the cam 616 with which the receiving portion 644 is in contact switches from one of the pressing portions 617 to one of the notched portions 618. At this time, the holding portion 632 is rotated forward around the central axis of the support shaft 636 by the energizing force of the coil spring 637, and the fixed blade 631 moves from the retracted position to the ready position. At almost the same time, the rotary blade 621 that is in the position that is closest to the cutting position R1 on the upstream side in the direction of rotation of the rotating body 620 moves to the cutting position R1. In the example that is shown in FIG. 9, the rotary blade 621 moves to the cutting position R1 when the rotating body 620 rotates from zero degrees to 47 degrees.

Thus, at the cutting position R1, the rotary blade 621 and the fixed blade 631 slide together in a shearing action that cuts the tape 3A in a straight line from the left edge to the right edge of the tape 3A. As explained previously, in the left-right direction, the rotary blade 621 is inclined in relation to the cutting edge 631A of the fixed blade 631 (refer to FIG. 2). A shear angle is formed by the rotary blade 621 and the fixed blade 631, so the tape 3A can be cut with a comparatively low shear force.

In the present embodiment, when one of the rotary blades 621 is at the cutting position R1, all of the other rotary blades 621 are in positions that are separated from the feed path P. In other words, when the one of the rotary blades 621 is cutting the tape 3A, all of the other rotary blades 621 are separated from the feed path P. Thus, during the cutting of the tape 3A by the one of the rotary blades 621, the other rotary blades 621 are inhibited from interfering with the tape 3A, making it possible to achieve accurate cutting and smooth feeding of the tape 3A.

Next, the rotary blade 621 that has cut the tape 3A at the cutting position R1 moves below the feed path P as the rotating body 620 rotates. At almost the same time, the portion of the cam 616 with which the receiving portion 644 is in contact switches from one of the notched portions 618 to one of the pressing portions 617. At this time, the holding portion 632 rotates rearward around the central axis of the support shaft 636 against the energizing force of the coil spring 637, and the fixed blade 631 moves from the ready position to the retracted position.

For its part, the tape 3A (that is, the label) that has been cut at the cutting position R1 is moved downstream (that is, forward) along the feed path P by the inertia of being fed. Furthermore, the central axis O is offset from the feed path P, and the rotary blade 621 comes into contact with the tape 3A that is positioned at the cutting position R1 at the angle r of 17 degrees. Therefore, the tape 3A that is cut at the cutting position R1 is energized downward toward the front by the rotary blade 621 that has cut the tape 3A. In other words, the rotary blade 621 that has rotated to the cutting position R1 not only cuts the tape 3A at the cutting position R1, but also sends the cut tape 3A smoothly downstream along the feed path P.

In the present embodiment, when the rotating body 620 rotates by a specified amount after the tape 3A is cut, the rotary blade 621 that is in the position that is closest to the discharge position R2 on the upstream side in the direction of rotation of the rotating body 620 moves to the discharge position R2 before the next rotary blade 621 rotates to the cutting position R1. In the example that is shown in FIG. 9, the rotary blade 621 that was positioned directly below the central axis O in the standby position moves upward to the discharge position R2 when the rotating body 620 rotates from zero degrees to 90 degrees.

Thus, at the discharge position R2, the rotary blade 621 that rotates upward from below energizes the rear edge of the tape 3A that was cut at the cutting position R1. In other words, after the tape 3A on the feed path P has been cut by the rotary blade 621 at the cutting position R1, the tape 3A is energized around the central axis O by the rotary blade 621 at the discharge position R2. Therefore, the cut tape 3A is sent smoothly downstream along the feed path P even more forcefully and is reliably discharged to the outer side of the trajectory R.

After the tape 3A has been cut, the printed tape 3A that is fed along the feed path P advances from the cutting position R1 into the area that is on the inner side of the trajectory R. When the rotating body 620 rotates a further 120 degrees after the preceding cutting of the tape 3A, the tape 3A is cut again in the same manner as previously described, and the cut tape 3A is discharged to the outer side of the trajectory R.

In the present embodiment, when one of the plurality of rotary blades 621 is at the cutting position R1, at least another of the rotary blades 621 is on the same side of the feed path P as the fixed blade 631. When the tape 3A is fed along the feed path P into the area that is on the inner side of the trajectory R, the tape 3A passes through a gap between the central axis O and the rotary blade 621 that is on the same side of the feed path P as the fixed blade 631.

Thus one of the rotary blades 621 (first rotary blade) that cut the tape 3A rotates to the same side of the feed path P as the fixed blade 631 (that is, the opposite side of the feed path P from the central axis O). Then another of the rotary blades 621 (second rotary blade), one which is positioned upstream in the direction of rotation from the first rotary blade 621 that cut the tape 3A, cuts that tape 3A. At this time, the tape 3A that has been cut by the second rotary blade 621 passes through the gap that is provided between the first rotary blade 621 and the central axis O and is fed downstream along the feed path P. It is therefore possible to inhibit the rotary blade 621 that has cut the tape 3A from obstructing the feeding of the tape 3A that the rotary blade 621 itself has cut.

In the rotary cutter device 6, the series of operations that is described above is performed three times, and three labels are made, for each complete revolution (each 360-degree rotation) of the rotating body 620. In the present embodiment, the plurality of rotary blades 621 are disposed around the central axis O such that a position of the center of gravity of the plurality of rotary blades 621 is substantially coincident with the central axis O. Therefore, the rotational balance of the rotating body 620 is good, and the tape 3A can easily be cut into uniform lengths by performing simple control that feeds the tape 3A and rotates the rotary blades 621 at constant speeds. More specifically, disposing the three rotary blades 621 at 120-degree intervals around the central axis O creates the preferable rotational balance for the rotating body 620 and makes it possible to cut the tape 3A efficiently and accurately.

As explained above, the rotary cutter device 6 according to the present embodiment includes the rotating body 620, in which the plurality of rotary blades 621 are provided around the central axis O and a gap is provided between each of the rotary blades 621 and the central axis O. The tape 3A that is fed is cut between the fixed blade 631 and the rotary blade 621 that has rotated to the cutting position R1. The feed path P for the tape 3A passes from the cutting position R1 through the area that is on the inner side of the trajectory R. The feed path P extends from the discharge position R2, which is on the opposite side from the cutting position R1, into the area that is on the outer side of the trajectory R.

Thus, for each complete revolution of the rotating body 620, the tape 3A that is being fed is cut a plurality of times in sequence, so the tape 3A can be cut efficiently. Furthermore, the tape 3A that has been cut at the cutting position R1 can be fed to the outer side of the trajectory R through the gap that is provided between each of the rotary blades 621 and the central axis O. Therefore, the rotary blades 621 that are in positions other than the cutting position R1 can be inhibited from interfering with the tape 3A.

Note that the present disclosure is not limited by the embodiment that has been described above, and various types of modifications can be made. Modified examples of the present disclosure will be explained with reference to FIGS. 10 to 12. In the explanations that follow, structural elements that are identical to the embodiment that has been described above are assigned the same reference numerals, and explanations of them will be omitted. Only the points that are different from the embodiment that has been described above will be explained.

Figure 10:
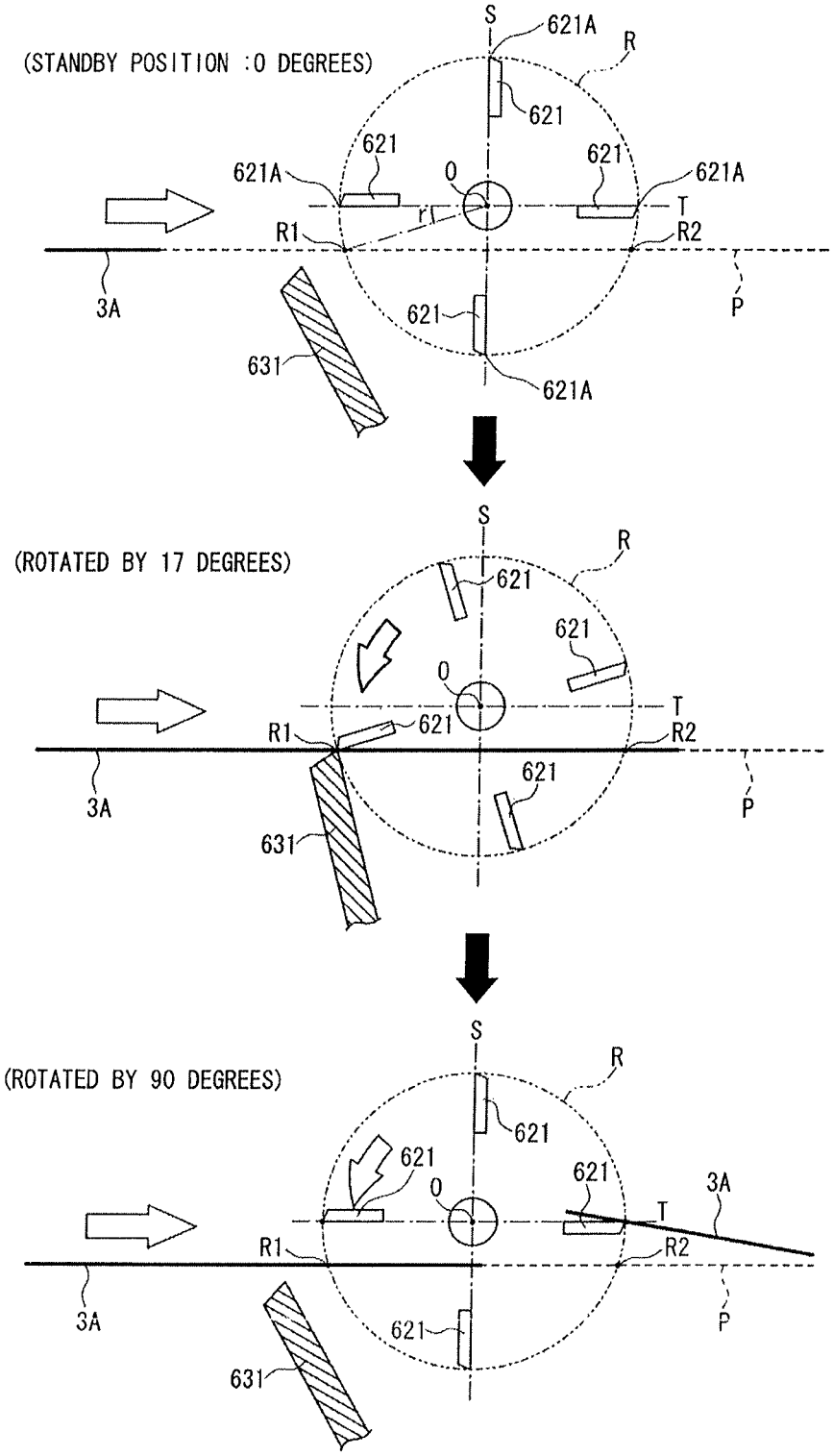
FIG. 10 is an explanatory figure that shows the flow of the operation of cutting the tape in a first modified example.

As shown in FIG. 10, the rotary cutter device 6 according to a first modified example is provided with four rotary blades 621. In a side view, the four rotary blades 621 are disposed at equal intervals of 90 degrees around the central axis O, and a gap that extends along the central axis O is provided between each of the rotary blades 621 and the central axis O. When the main unit 1 is started, each of the rotary blades 621 moves to the standby position. One of the rotary blades 621 thus moves to the position directly below the central axis O that is the lowest position for the rotary blades 621. One of the rotary blades 621 moves to a position directly above the central axis O that is the highest position for the rotary blades 621. The two rotary blades 621 move to positions that are higher than the central axis O, where they are symmetrically inclined at angles of 90 degrees forward and rearward from the vertical plane S.

When the printing operation of the main unit 1 is started, the printed tape 3A that is discharged from the main unit 1 toward the rotary cutter device 6 is fed along the feed path P. The control board 22 causes the rotating body 620 (that is, the four rotary blades 621) to rotate in synchronization with the feeding of the tape 3A. When the rotating body 620 rotates by a specified amount, the rotary blade 621 that is in the position that is closest to the cutting position R1 on the upstream side in the direction of rotation of the rotating body 620 moves to the cutting position R1. In the example that is shown in FIG. 10, the rotary blade 621 moves to the cutting position R1 when the rotating body 620 rotates from zero degrees to 17 degrees. At the cutting position R1, the tape 3A is cut by the coordinated operating of the rotary blade 621 and the fixed blade 631.

When the rotating body 620 rotates by a specified amount after the tape 3A is cut, the rotary blade 621 that is in the position that is closest to the discharge position R2 on the upstream side in the direction of rotation of the rotating body 620 moves to the discharge position R2 before the next rotary blade 621 rotates to the cutting position R1. In the example that is shown in FIG. 10, the rotary blade 621 that was positioned directly below the central axis O in the standby position moves upward to the discharge position R2 when the rotating body 620 rotates from zero degrees to 90 degrees. Thus, at the discharge position R2, the tape 3A that was cut at the cutting position R1 is energized by the rotary blade 621 and discharged toward the outer side of the trajectory R.

After the tape 3A has been cut, the printed tape 3A that is fed along the feed path P advances from the cutting position R1 into the area that is on the inner side of the trajectory R. When the rotating body 620 rotates a further 90 degrees after the preceding cutting of the tape 3A, the tape 3A is cut again in the same manner as previously described, and the cut tape 3A is discharged to the outer side of the trajectory R. In the rotary cutter device 6, the series of operations that is described above is performed four times, and four labels are made, for each complete revolution (each 360-degree rotation) of the rotating body 620.

Figure 11:
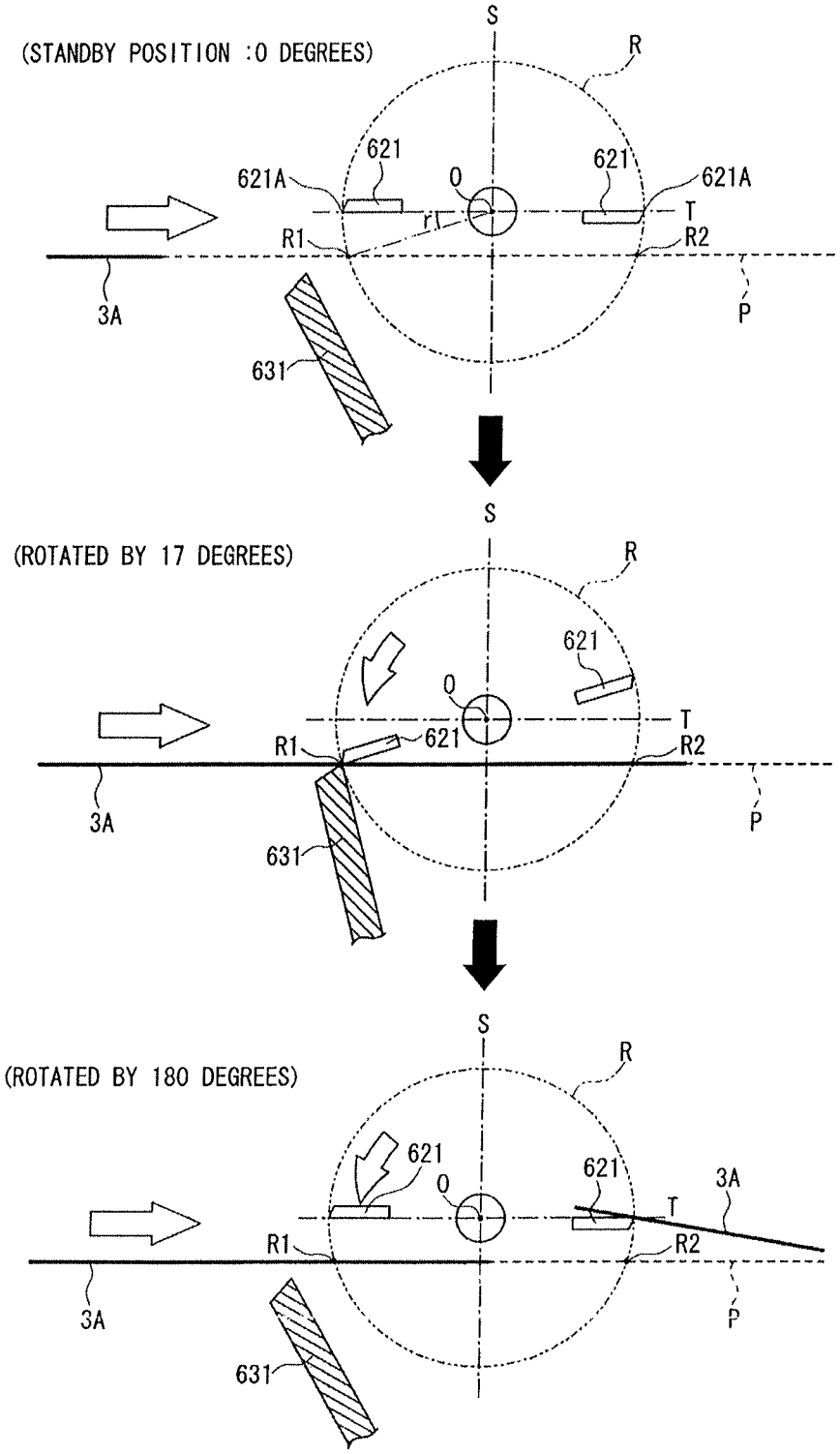
FIG. 11 is an explanatory figure that shows the flow of the operation of cutting the tape in a second modified example.

As shown in FIG. 11, the rotary cutter device 6 according to a second modified example is provided with two rotary blades 621. In a side view, the two rotary blades 621 are disposed at equal intervals of 180 degrees around the central axis O, and a gap that extends along the central axis O is provided between each of the rotary blades 621 and the central axis O. When the main unit 1 is started, each of the rotary blades 621 moves to the standby position. The two rotary blades 621 thus move to positions that are higher than the central axis O, where the two rotary blades 621 are symmetrically inclined at angles of 90 degrees forward and rearward from the vertical plane S.

When the printing operation of the main unit 1 is started, the printed tape 3A that is discharged from the main unit 1 toward the rotary cutter device 6 is fed along the feed path P. The control board 22 causes the rotating body 620 (that is, the two rotary blades 621) to rotate in synchronization with the feeding of the tape 3A. When the rotating body 620 rotates by a specified amount, the rotary blade 621 that is in the position that is closest to the cutting position R1 on the upstream side in the direction of rotation of the rotating body 620 moves to the cutting position R1. In the example that is shown in FIG. 11, the rotary blade 621 moves to the cutting position R1 when the rotating body 620 rotates from zero degrees to 17 degrees. At the cutting position R1, the tape 3A is cut by the coordinated operating of the rotary blade 621 and the fixed blade 631.

When the rotating body 620 rotates by a specified amount after the tape 3A is cut, the rotary blade 621 that is in the position that is closest to the discharge position R2 on the upstream side in the direction of rotation of the rotating body 620 moves to the discharge position R2 before the next rotary blade 621 rotates to the cutting position R1. In the example that is shown in FIG. 11, when the rotating body 620 rotates from zero degrees to 180 degrees, the rotary blade 621 cuts the tape 3A at the cutting position R1, then rotates upward to the discharge position R2. Thus, at the discharge position R2, the tape 3A that was cut at the cutting position R1 is energized by the rotary blade 621 and discharged toward the outer side of the trajectory R.

After the tape 3A has been cut, the printed tape 3A that is fed along the feed path P advances from the cutting position R1 into the area that is on the inner side of the trajectory R. When the rotating body 620 rotates a further 180 degrees after the preceding cutting of the tape 3A, the tape 3A is cut again in the same manner as previously described, and the cut tape 3A is discharged to the outer side of the trajectory R. In the rotary cutter device 6, the series of operations that is described above is performed two times, and two labels are made, for each complete revolution (each 360-degree rotation) of the rotating body 620.

As explained above, in the rotary cutter device 6 according to the first and second modified examples, for each complete revolution of the rotating body 620, the tape 3A that is being fed is cut a plurality of times in sequence, in the same manner as in the embodiment that is described above. Furthermore, the tape 3A that has been cut at the cutting position R1 can be fed to the outer side of the trajectory R through the gap that is provided between each of the rotary blades 621 and the central axis O. Therefore, even if the number and the positions of the rotary blades 621 are changed, the tape 3A can be cut efficiently, and the rotary blades 621 that are in positions other than the cutting position R1 can be inhibited from interfering with the tape 3A, the same effects that are achieved by the embodiment that is described above.

Furthermore, according to the first and second modified examples, the same effects that are achieved by the embodiment that is described above are achieved, as explained below. When each of the rotary blades 621 is in the standby position, all of the rotary blades 621 are set apart from the cutting position R1 and the discharge position R2, so the tape 3A is able to move without interference from the rotary blades 621 and the fixed blade 631.

When one of the plurality of rotary blades 621 is at the cutting position R1, the other rotary blade 621 or all of the other rotary blades 621 are in positions that are separated from the feed path P, making it possible to achieve accurate cutting and smooth feeding of the tape 3A. The rotary blade 621 at the discharge position R2 energizes the rear edge of the cut tape 3A, so the tape 3A can be reliably discharged to the outer side of the trajectory R. The tape 3A passes through the gap that is provided between the central axis O and the rotary blade 621 that is on the same side of the feed path P as the fixed blade 631, so it is possible to inhibit the rotary blade 621 from obstructing the feeding of the tape 3A that the rotary blade 621 itself has cut.

Figure 12:
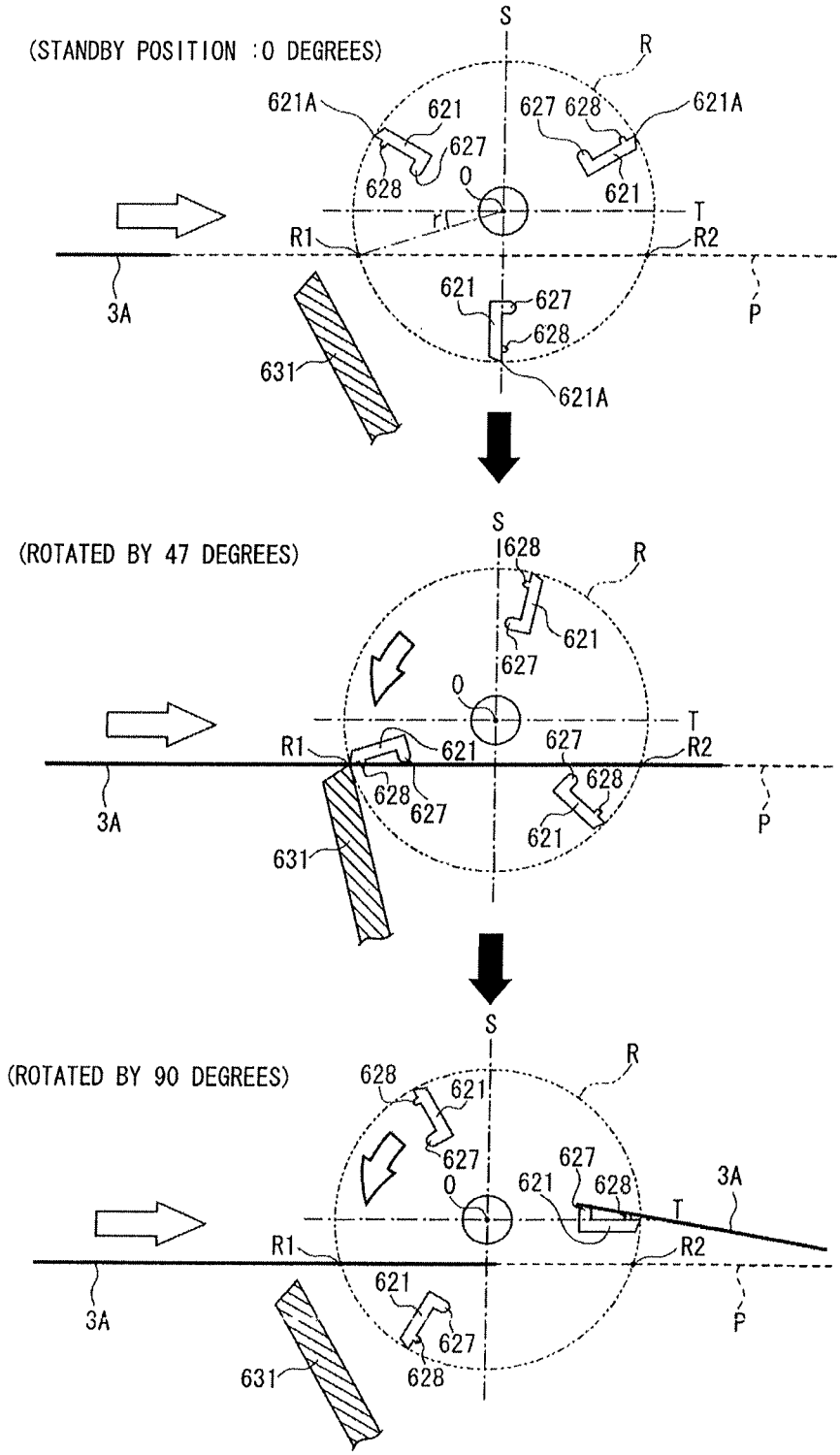
FIG. 12 is an explanatory figure that shows the flow of the operation of cutting the tape in a third modified example.

As shown in FIG. 12, in the rotary cutter device 6 according to a third modified example, adhesion preventing portions 627 and contact preventing portions 628 are respectively provided on the three rotary blades 621 in the embodiment that is described above. The adhesion preventing portions 627 are provided close to the ends of the rotary blades 621 toward the central axis O. The adhesion preventing portions 627 prevent the cut tape 3A from adhering to the rotary blades 621. The contact preventing portions 628 are provided close to the cutting edges 621A of the rotary blades 621. The contact preventing portions 628 prevent the cut tape 3A from coming into contact with the cutting edges 621A of the rotary blades 621. The adhesion preventing portions 627 and the contact preventing portions 628 both project from the downstream sides of the rotary blades 621 in the direction of rotation, and the projections extend in parallel to the central axis O.

As explained previously, at the discharge position R2, the cut tape 3A is energized in the direction of rotation by the rotary blade 621. At that time, the bottom face of the cut tape 3A comes into contact with the adhesion preventing portion 627 and the contact preventing portion 628. The bottom face of the tape 3A is inhibited by the adhesion preventing portion 627 from coming into contact with the rotary blade 621. Thus the rotary cutter device 6 is able to discharge the cut tape 3A smoothly without causing the tape 3A to adhere to the rotary blade 621. The cutting edge 621A of the rotary blade 621 is inhibited by the contact preventing portion 628 from coming into contact with the bottom face of the tape 3A. Thus the rotary cutter device 6 is able to discharge the cut tape 3A without damaging the tape 3A.

In the rotary cutter device 6 according to the embodiment that is described above and the modified examples, the central axis O is offset from the feed path P, and a rotating shaft that extends along the central axis O of the rotating body 620 is not provided. Alternatively, the rotating body 620 may be provided with a rotating shaft that extends along the central axis O, which is offset from the feed path P. In the case where the rotating shaft that extends along the central axis O of the rotating body 620 is not provided, the central axis O may also be provided on the feed path P. In both cases, it is possible to form the gap through which the tape 3A can pass through the area that is on the inner side of the trajectory R.

In the rotary cutter device 6 according to the embodiment that is described above and the modified examples, in order to provide the rotating body 620 with a good rotational balance, the plurality of rotary blades 621 are disposed such that a position of the center of gravity of the plurality of rotary blades 621 is substantially coincident with the central axis O. Alternatively, the plurality of rotary blades 621 may also be disposed at different angles around the central axis O, and the rotary blades 621 that are disposed around the central axis O may also have different weights and shapes. In those cases, the rotary cutter device 6 would be able to cut the tape 3A at uniform lengths by controlling the feeding of the tape 3A and the rotation of the rotary blades 621.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A rotary cutter device, comprising:

a rotating body that is configured to be rotatable around a central axis, the central axis being a virtual straight line;

a plurality of rotary blades that are provided on the rotating body in parallel to the central axis, each of the plurality of rotary blades being separated from the central axis and having a cutting edge on an end of the rotary blade that is farthest from the central axis, the cutting edges of the plurality of rotary blades extending in parallel to the central axis and describing a trajectory when the plurality of rotary blades rotate;

a fixed blade that is provided on an outer side of the trajectory and has a cutting edge on an end of the fixed blade, the cutting edge of the fixed blade facing the trajectory;

a feeding portion that is configured to feed a sheet-shaped object along a linear feed path that passes close to the fixed blade, the feed path passing from a cutting position through an area that is on the inner side of the trajectory, the cutting position being a position where one of the cutting edges of the plurality of rotary blades faces the cutting edge of the fixed blade, and the feed path then extending from a discharge position into an area that is on the outer side of the trajectory, the discharge position being a position where the feed path and the trajectory intersect and being different from the cutting position; and a control portion that is configured to rotate the plurality of rotary blades around the central axis toward the fixed blade from the opposite side of the feed path from the fixed blade, wherein the plurality of rotary blades are disposed around the central axis such that, when a first blade is at the cutting position, all of one or more second blades are in positions that are separated from the feed path, the first blade being one of the plurality of rotary blades that is at the cutting position, one or more second blades being one or more of the plurality of rotary blades other than the first blade.

2. The rotary cutter device according to claim 1, wherein the central axis is located on the opposite side of the feed path from the fixed blade.

3. The rotary cutter device according to claim 1, wherein the plurality of rotary blades are disposed around the central axis such that, when one of the plurality of rotary blades is at the cutting position, at least another one of the plurality of rotary blades that is not at the cutting position is on the same side of the feed path as the fixed blade.

4. The rotary cutter device according to claim 1, wherein the plurality of rotary blades are disposed around the central axis such that a position of the center of gravity of the plurality of rotary blades is substantially coincident with the central axis.

5. The rotary cutter device according to claim 4, wherein the plurality of rotary blades are three rotary blades that are disposed around the central axis at 120-degree intervals.

6. The rotary cutter device according to claim 1, wherein the plurality of rotary blades include projections, each of the projections projecting from each of the plurality of rotary blades in a direction of rotation of the plurality of rotary blades.

* * * * *